United States Patent [19]

Nagata

[11] Patent Number: 4,632,535

[45] Date of Patent: Dec. 30, 1986

[54] DEVELOPING DEVICE

[75] Inventor: Niroo Nagata, Kawasaki, Japan

[73] Assignee: Kabushiki Kaisha Toshiba, Kawasaki, Japan

[21] Appl. No.: 727,260

[22] Filed: Apr. 25, 1985

[30] Foreign Application Priority Data

Apr. 27, 1984 [JP] Japan ..... 59-85638

[51] Int. Cl.[4] ..... G03G 15/00

[52] U.S. Cl. ..... 355/3 DD; 355/3 R; 118/656

[58] Field of Search ..... 355/3 R, 3 DD; 118/656, 118/657, 658, 653

[56] References Cited

U.S. PATENT DOCUMENTS 3,232,190 2/1966 Willmott et al. .
3,866,574 2/1975 Hardennrook et al. .
4,232,628 11/1980 Shelffo .
4,528,937 7/1985 Kunno et al. ..... 355/3 DD

FOREIGN PATENT DOCUMENTS 0137360 10/1981 Japan ..... 118/658
0045468 3/1984 Japan ..... 355/3 DD

*Primary Examiner*—Arthur T. Grimley
*Assistant Examiner*—David S. Warren
*Attorney, Agent, or Firm*—Cushman, Darby & Cushman

[57] ABSTRACT

A developing device, which develops a latent image on a photoconductive drum by a non-magnetic developing agent, is provided with a charging blade pressed against the surface of a developing roller to form a layer of the charged developing agent on the surface of the developing roller, and a recovery blade pressed against the surface of the developing roller so as to allow collection into a hopper of the developing agent which is attached to the developing roller and which is delivered to the recovery blade without having been used for development. The recovery blade has a slant such that the developing agent delivered from the hopper is guided to the side of the devloping roller. One end of the recovery blade is attached to the hopper, and the other end of the recovery blade is located outside the hopper so as to be in plane contact with the developing roller at the middle portion of the recovery blade.

9 Claims, 3 Drawing Figures

DEVELOPING DEVICE

BACKGROUND OF THE INVENTION

1. Field of the Invention

The present invention to a developing device adapted for use in, for example, an electrophotographic copying machine, and more specifically to a developing device for developing a latent image by means of a one-component developing agent.

2. Description of the Prior Art

Recently, developing devices have been proposed for electrophotographic copying machines which use a one-component developing agent containing no carrier for development. FIG. 1 shows one such prior art developing device. In FIG. 1, a developing roller 16, as a developing agent carrying means, is disposed opposite a developing agent feeding outlet 14 of a developing agent hopper (toner hopper) 12 which stores a developing agent 10 therein. A charging blade 18 and a recovery blade (seal blade) 20 are attached to the upper and lower edge portions of the developing agent feeding outlet 14, respectively. The respective distal end portions of the two blades 18 and 20 are pressed against the outer peripheral surface of the developing roller 16 so that the developing agent feeding outlet 14 is closed by the developing roller 16 and the blades 18 and 20. The developing agent 10 in the developing agent hopper 12 stirred by a stirring member 22 is delivered as the developing roller 16 rotates. The delivered developing agent 10 is charged and formed into a thin layer by the charging blade 18. The charged developing agent 10 serves to develop an electrostatic latent image which is previously formed on a photoconductive drum 24 as an image carrier.

An untransferred portion 10' of the developing agent 10, having passed through a developing region D where the photoconductive drum 24 and the developing roller 16 are nearest to each other, still remains on the developing roller 16 by the agency of a reflected image force. As the developing roller 16 rotates, the developing agent portion 10' is conveyed and re-collected into the developing agent hopper 12, passing by the recovery blade 20.

In the conventional developing device of this type, however, the distal end of the recovery blade 20 extends toward the charging blade 18 so that the recovery blade 20 covers the top surface portion of the developing roller 16 which faces the developing agent feeding outlet 14. In other words, the distal end of the recovery blade 20 is buried in the developing agent 10 stored in the developing agent hopper 12. Accordingly, a developing agent feed zone A or that portion of the outer peripheral surface of the developing roller 16 which is in contact with the developing agent 10 in the developing agent hopper 12 is narrow. Thus, if the developing roller 16 is reduced in diameter, it will not be able to be satisfactorily supplied with the developing agent 10.

In the prior art developing device constructed in this manner, the distal end of the recovery blade 20 is located in the developing agent 10, as mentioned before. Therefore, that portion of the developing agent 10 which is in contact with that surface of the recovery blade 20 on the side (reverse side) not in contact with the developing roller 16 is prevented from being supplied to the developing roller 16 by the recovery blade 20. Thus, dead space B of a substantial size is produced at the back of the recovery blade 20, resulting in a waste of the developing agent 10.

SUMMARY OF THE INVENTION

The present invention is intended to provide a developing device in which a recovery blade may be mounted in a manner such that a sufficiently wide developing agent feed zone can be ensured without producing any substantial dead space, and in which a nonmagnetic developing agent can securely be fed for steady friction attachment to a carrying means, even with the use of slender carrying means.

In order to achieve the above object, according to the present invention, that portion of the nonmagnetic developing agent on the developing agent carrying means which is conveyed without being used for development is re-collected into the developing agent storage means by means of a recovery member which is pressed against the developing agent carrying means with a slant such that the developing agent stored in the developing agent storage means is guided to the side of the developing agent carrying means, and the distal end of the recovery member is located outside the developing agent storage means so as to be in plane contact with the developing agent carrying means.

DETAILED DESCRIPTION OF THE PREFERRED EMBODIMENTS

Figure 1:
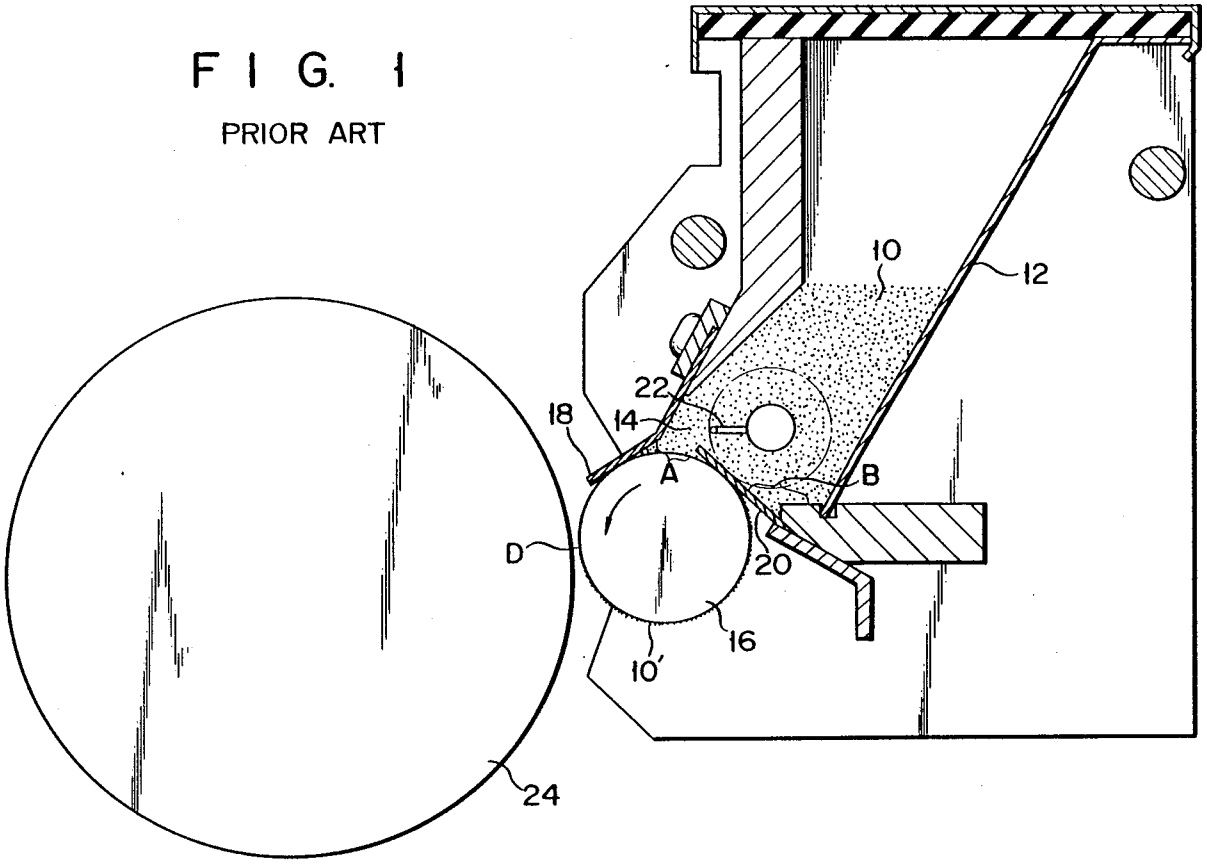
FIG. 1 PRIOR ART
FIG. 1 is a side sectional view schematically showing the construction of a prior art developing device.
Figure 2:
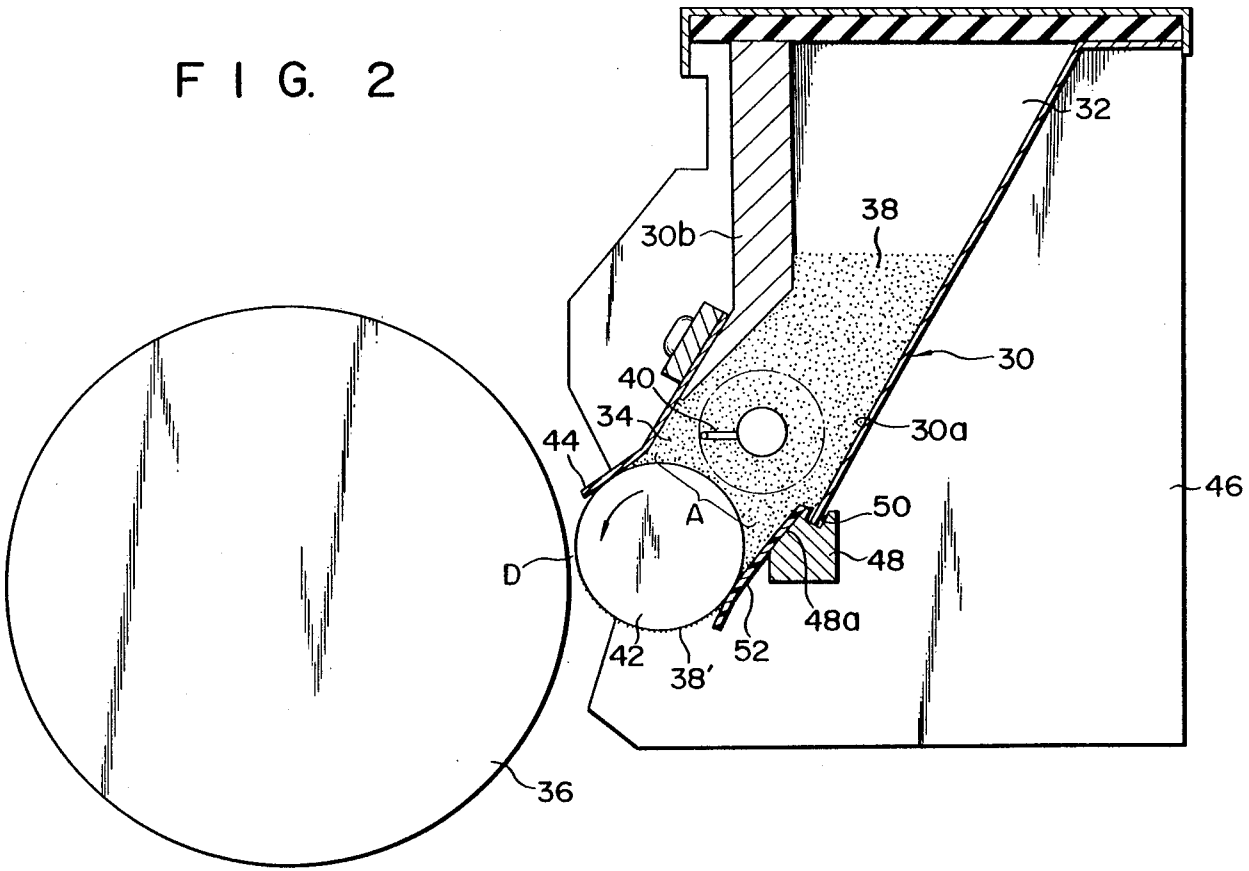
FIG. 2 is a side sectional view schematically showing the construction of one embodiment of a developing device according to the present invention.

Referring now to FIG. 2, one embodiment of a developing device according to the present invention will be described in detail.

In FIG. 2, a developing agent hopper 30 functions as developing agent srorage means. The hopper 30 is formed of a casing which is opened at both top and bottom ends. Top and bottom openings 32 and 34 of the hopper 30 are defined as a developing agent supply inlet and a developing agent feeding outlet, respectively. The hopper 30 is disposed on one side of a photoconductive drum 36 as an image carrier. A side plate **30*a* of the hopper 30 on the side farther from the photoconductive drum 36 is inclined downwardly toward the photoconductive drum 36**.

A nonmagnetic toner 38 as a one-component developing agent is stored in the hopper 30. A stirring roller 40 for stirring the toner 38 is disposed in the hopper 30. The hopper 30 is so designed that the developing agent 38 therein is fed along the slanted side plate **30*a* to be delivered to the bottom end opening or the developing agent feeding outlet 34 by its own weight or gravity and the stirring roller 40** in rotation.

A developing roller 42 as developing agent carrying means is disposed adjacent to the photoconductive drum 36, facing the developing agent feeding outlet 34. The developing roller 42 rotates in the counterclockwise direction as indicated by an arrow in FIG. 2. The photoconductive drum 36 and the developing roller 42 are spaced at a predetermined narrow distance from each other. This distance is greater than the thickness of a developing agent layer formed on the developing roller 42. A developing region D is defined in the area where the photoconductive drum 36 and the developing roller 42 are nearest to each other.

The upper end of a charging blade 44 serving also as a developing agent layer forming member is attached to the upper edge portion of the developing agent feeding outlet 34 over the developing roller 42, i.e., the lower portion of a side plate 30*b* of the hopper 30 on the side nearer to the photoconductive drum 36. The charging blade 44 is inclined downwardly toward the photoconductive drum 36. The middle portion of the charging plate 44 is in plane contact with the outer peripheral surface of the developing roller 42 under a predetermined pressure.

The lower end portion of the slanted side plate 30*a* of the developing agent hopper 30 is fitted in a groove 50 in the top end face of a stay 48 which is attached to a casing 46 of the developing device. A slant face 48*a* is formed at that portion of the stay 48 which faces the developing roller 42. The upper end portion (proximal end portion) of a recovery blade (seal blade) 52 as a recovery member with a thickness of about 50 to 100 microns formed of a plastic film, such as Mylar (trademark), is attached to the slant face 48*a*. The recovery blade 52 is inclined downwardly toward the developing roller 42, having its middle portion elastically in plane contact with the developing roller 42. The lower end portion (distal end portion) of the recovery blade 52 extends as a free end outside the hopper 30.

While the developing roller 42 is not rotating, in this arrangement, the gaps between the developing roller 42 and the side plates 30*b* and 30*a* of the hopper 30 are closed by the charging blade 44 and the recovery blade 52, respectively. Thus, the developing agent 38 in the hopper 30 is prevented from leaking out through the developing agent feeding outlet 34.

The operation of the developing device with the aforementioned construction will now be described.

The developing agent 38 taken out by the rotating developing roller 42 is charged by the charging blade 44 and forms a thin layer on the outer peripheral surface of the developing roller 42. When the charged developing agent 38 reaches the developing region D, it flies from the developing roller 42 and adheres to an electrostatic latent image previously formed on the photoconductive drum 11, thereby developing the electrostatic latent image.

After passing through the developing region D, an untransferred portion 38′ of the developing agent 38 on the developing roller 42 keeps on adhering to the developing roller 42 by the agency of a reflected image force. As the developing roller 42 rotates, the untransferred developing agent portion 38′ is conveyed, passing between the recovery blade 52 and the developing roller 42 in a manner such that the recovery blade 52 is pushed outward. Thus, the untransferred developing agent portion 38′ is re-collected in the hopper 30. Here the middle portion of the recovery blade 52 is elastically in plane contact with the outer peripheral surface of the developing roller 42. Therefore, the untransferred developing agent portion 38′ on the developing roller 42 is securely re-collected in the hopper 30 without being scraped off the surface of the developing roller 42 by the recovery blade 52.

In the developing device according to this one embodiment, the recovery blade 52 is in contact with that portion of the developing roller 42 below the extreme right-hand side portion thereof. Accordingly, the top side of the developing roller 42 can be fully exposed, so that a sufficiently wide developing agent feed zone A can be secured even though the developing roller 42 is reduced in size. Since the distal end (lower end) of the recovery blade 52 is located outside the hopper 30, there is no wasted space around the recovery blade 52. Thus, there is no possibility of the developing agent being collected in vain. Namely, the recovery blade 52 is disposed in plane contact with the developing roller 42, inclined so that the developing agent 38 from the hopper 30 is guided to the developing roller 42 by that portion of the recovery blade 52 on the same side (upper side) as the hopper 30 with respect to the portion in contact with the developing roller 42. Thus, the developing agent 38, guided by the recovery blade 52, flows to the side of the developing roller 42, so that there is a smooth, equal distribution of the developing agent.

In the case of this embodiment, that portion A of the developing roller 42 exposed to the hopper 30 is so wide that sufficient supply of the developing agent 38 from the hopper 30 to the developing roller 42 can be maintained even if the developing roller 42 is reduced in diameter.

The lower the position where the recovery blade 52 and the developing roller 42 are in contact with each other, the wider the exposed portion A will be. This relation ensures a smooth coating of the developing agent on the developing roller 42, and never leads to formation of any dead zone.

The charging blade 44 as the developing agent forming member is also in plane contact with the developing roller 42.

Figure 3:
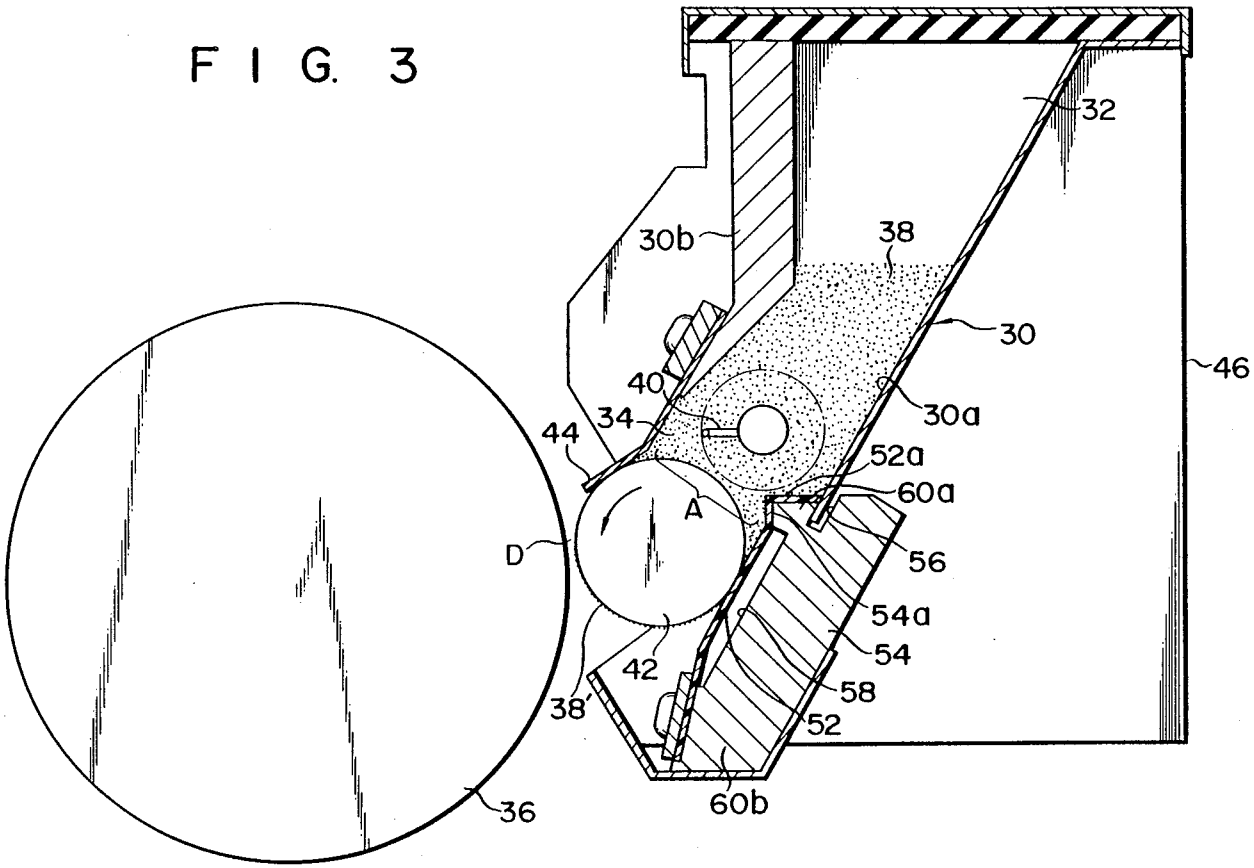
FIG. 3 is a side sectional view schematically showing the construction of another embodiment of the developing device according to the invention.

It is to be understood that the present invention is not limited to the arrangement of the one embodiment described above, and that various changes and modifications may be effected therein by one skilled in the art without departing from the scope or spirit of the invention. In the above embodiment, for example, the recovery blade 52 is cantilevered, having its upper end portion (proximal end portion) supported on the stay 48 and its lower end portion (distal end portion) left free. Alternatively, however, the recovery blade may be supported at both ends, as in a developing device according to another embodiment shown in FIG. 3.

The developing device according to the second embodiment will now be described in detail. In the description to follow, like reference numerals are used to designate like members as described in connection with the first embodiment, and a detailed description of those members is omitted.

The lower end portion of a slanted side plate 30*a* of a developing agent hopper 30 is fitted in a groove 56 in the top end face of a stay 54 which is attached to a casing 46 of the developing device. That surface of the stay 54 opposed to a developing roller 42 forms a slant face 54*a* which is declined toward a photoconductive drum 36. A depression 58 is formed in that portion of the slant face 54*a* opposed to the developing roller 42. That portion of the slant face 54*a* located above the depression 58 is defined as a first mounting surface 60*a*, and the portion below the depression 58 as a second mounting surface 60*b*.

A recovery blade 52 is stretched with its upper and lower end portions attached to the first and second mounting surfaces 60*a* and 60*b*, respectively. In other words, the recovery blade 52 is supported at both ends with its middle portion suspended over the depression 58. The central portion of the recovery blade 52 is elastically in plane contact with the developing roller 42. An upper edge portion 52*a* of the recovery blade 52 is bent along the top surface side of the first mounting surface 60*a* so that a developing agent 38 is prevented from penetrating the space behind the recovery blade 52, that is, the depression 58 of the stay 54, to damage the recovery blade 52.

The recovery blade may be formed from a metal sheet with a thickness of about 0.5 mm so that it serves as an auxiliary charging blade for charging the re-collected developing agent.

According to the present invention, as described above, a recovery member may be mounted in a manner such that a sufficiently wide developing agent feed zone can be smoothly evenly produced with no patches, and a developing agent can reliably be fed for a steady developing operation even with the use of slender developing agent carrying means.

What is claimed is:

1. A developing device which develops a latent image formed on an image carrier by a nonmagnetic developing agent, comprising:

developing agent storage means for storing a nonmagnetic developing agent therein, said storage means having an opening on the lower side;

developing agent carrying means disposed between the image carrier and the opening of the storage means and having a feed zone covering a substantial portion of a surface to which the nonmagnetic developing agent is frictionally attached, said carrying means being adapted to carry the nonmagnetic developing agent from the storage means to the image carrier upon rotational movement of the surface;

a layer forming member pressed against the surface of the carrying means to form a layer of the nonmagnetic developing agent from the storage means on the surface of the carrying means; and a recovery member pressed against the surface of the carrying means so as to allow collection into the storage means of that portion of the nonmagnetic developing agent frictionally attached to the carrying means by the layer forming member which portion is delivered to the recovery member without having been used for development, and to prevent the nonmagnetic developing agent from flowing out of the storage means, wherein the feed zone extends completely from the recovery member to the layer forming member, wherein said recovery member has a slant such that the nonmagnetic developing agent delivered from the storage means is guided to the side of the carrying means, one end of the recovery member being attached to the storage means, and the other end of the recovery member being located outside the storage means so as to be in plane contact with the carrying means at the middle portion of the recovery member.

2. The developing device according to claim 1, wherein said one end of said recovery member is located higher than said other end.

3. The developing device according to claim 2, wherein said other end of said recovery member is a free end.

4. The developing device according to claim 2, wherein said one end of said recovery member is a fixed end.

5. The developing device according to claim 4, wherein said storage means includes a stay for supporting the recovery member only at the ends thereof.

6. The developing device according to claim 5, wherein said stay has a depression in the center, and that portion of the recovery member located over the depression is pressed against the surface of the carrying means.

7. The developing device according to claim 1, wherein said nonmagnetic developing agent is a one-component developer.

8. The developing device according to claim 1, wherein said carrying means is a cylindrical developing roller, and said surface consists about half of the outer peripheral surface of the developing roller.

9. The developing device according to claim 1, wherein said layer forming member is pressed against an upper portion of the surface of the carrying means and further wherein said recovery member is pressed against a lower portion of the same surface of the carrying means.

* * * * *